US006290026B1

(12) United States Patent
Takigawa

(10) Patent No.: US 6,290,026 B1
(45) Date of Patent: Sep. 18, 2001

(54) HYDRAULIC ELEVATOR

(75) Inventor: Yukihiro Takigawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/462,149

(22) PCT Filed: Jun. 7, 1998

(86) PCT No.: PCT/JP98/03035

§ 371 Date: Jan. 3, 2000

§ 102(e) Date: Jan. 3, 2000

(87) PCT Pub. No.: WO00/01605

PCT Pub. Date: Jan. 13, 2000

(51) Int. Cl.[7] ..... B66B 9/04
(52) U.S. Cl. ..... 187/253; 187/272
(58) Field of Search ..... 187/251, 252, 187/253, 266, 272, 274, 275, 273; 254/271, 264

(56) References Cited

FOREIGN PATENT DOCUMENTS

630848 A2 * 12/1994 (EP) .
60-6768 1/1985 (JP) .
62264186 11/1987 (JP) .
2-261790 A * 10/1990 (JP) ..... 187/253
4-41377 A * 2/1992 (JP) .
5-97354 A * 4/1993 (JP) ..... 187/272
8268664 10/1996 (JP) .
10-236746 A * 9/1998 (JP) .

* cited by examiner

*Primary Examiner*—Eileen D Lillis
*Assistant Examiner*—Thuy V. Tran
(74) *Attorney, Agent, or Firm*—Leydig, Voit & Mayer, Ltd.

(57) ABSTRACT

In a hydraulic elevator, first and second hydraulic jack units are disposed within a hoistway so as to straddle the vertically projected area of a car from both sides. Each of the first and second hydraulic jack units are composed of a hydraulic jack. Suspension ropes are wound around two suspension sheaves, moved up and down by the hydraulic jacks, respectively. Each suspension rope has a hoistway side fastening end fastened to a bottom portion of the hoistway and a car side fastening end fastened to a lower end portion of the car.

3 Claims, 8 Drawing Sheets

HYDRAULIC ELEVATOR

TECHNICAL FIELD

The present invention relates to a hydraulic elevator that is raised and lowered by a hydraulic jack unit.

BACKGROUND ART

FIG. 9 is a side elevational view showing a conventional hydraulic elevator disclosed in, for example, Japanese Patent Application Laid-Open No. 7-20827 and FIG. 10 is a plan view showing the hydraulic elevator shown in FIG. 9. In these drawings, a pair of guide rails 2 are disposed spaced from each other within a hoistway 1. A car 3 that is raised and lowered along the guide rails 2 is disposed between the guide rails 2. A plurality of guide shoes 4 are fixed to the car 3 as guide members which engage with the guide rails 2, respectively.

First and second hydraulic jacks 5 and 6 are installed on one side of the car 3 within the hoistway 1. These hydraulic jacks 5 and 6 have jack bases 5*a* and 6*a* fixed on a floor 1*b* of a pit 1*a* of the hoistway 1, cylinders 5*b* and 6*b* fixed on the jack bases 5*a* and 6*b*, and plungers 5*c* and 6*c* that are reciprocated in a vertical direction inserted into the cylinders 5*b* and 6*b*.

Upper end portions of the plungers 5*c* and 6*c* are connected to each other by a support frame 7. A rotatable suspension sheave 8 is mounted on the support frame 7. A pair of guide rails 9*a* and 9*b* for guiding the ascending/descending movement of the support frame 7 are fixed to the upper end portions of the cylinders 5*b* and 6*b*, respectively.

A hydraulic power unit 12 having an oil tank 11 is installed within a machine room 10 adjacent to the hoistway 1. The hydraulic power unit 12 is connected to the first and second hydraulic jacks 5 and 6 through a pipe 13 branched at a midway portion thereof.

A stationary member 14 is fixed to the floor 1*b* of the pit 1*b*. The car 3 is suspended within the hoistway 1 by a suspension rope 15 wound around the suspension sheave 8. The suspension rope 15 has a hoistway side fastening end 15*a* fastened to the stationary member 14 and a car side fastening end 15*b* fastened to the car 3. The car side fastening end 15*b* is fastened to a rope support beam 17 of the car 3 through a spring 16.

The operation will now be described. A pressurized oil is fed into the cylinders 5*b* and 6*b* of the first and second hydraulic jacks 5 and 6 from the hydraulic power unit 12 so that the plungers 5*c* and 6*c* are raised and the car 3 is raised along the guide rails 2. In this case, the elevating velocity of the car 3 is twice as fast as the elevating velocity of the plungers 5*c* and 6*c*. Also, the hydraulic oil within the cylinders 5*b* and 6*b* is fed back to the hydraulic power unit 12 by the weight of the car 3, allowing the car 3 to descend.

In this case, it should be noted that there is a predetermined upper limit of working pressure for respective hydraulic equipment such as the hydraulic pump (not shown), the hydraulic valve (not shown), the pipe 13, the hydraulic jacks 5 and 6 and the like within the hydraulic power unit 12. The upper limit of the working pressure is set to be greater than a value obtained by dividing twice the sum of the respective weights such as the tare weight (dead weight) of the car 3, the load, the weight of the suspension sheave 8 and the like by the cross-sectional area of the plungers 5*c* and 6*c*.

In the thus constructed conventional hydraulic elevator, a coupling force (the pair of forces that are the same in magnitude, but opposite in direction) about a fixed point of the suspension rope 15 in the car 3 is received by the guide shoes 4. The load (guide shoe reactive force) applied to the guide shoes 4 is given by the equation: $F=Wc\times Ex/H$, where F is the guide shoe reactive force, Wc is the weight of the car 3, Ex is the distance, in the opening direction of the doors, from the gravitational center of the car 3 to the suspension point thereof, and H is the interval between the upper and lower guide shoes 4 of the car 3, as shown in FIG. 11.

As described in the equation, the guide shoe reactive force is proportional to the distance Ex from the gravitational center of the car 3 to the suspension point in the opening direction of the doors. Accordingly, in a hydraulic elevator having a larger dimension in the opening direction of the doors of the car 3, there are certain instances where the car 3 can not be guided by the guide shoes 4.

For example, the guide shoe reactive force in a hydraulic elevator (car dimensions: opening direction of the doors dimension of 1,400 mm×depth dimension of 1,350 mm×door opening height of 2,100 mm) with a load of 750 kg, 11 persons standardized in accordance with Japanese Elevator Association is given as follows:

Namely, since the weight of the car is about 1.2 times the load, the relationship, $Wc=750\times1.2=900$ kg, is established. Normally, the position of the center of gravity is substantially at the center of the car in the opening direction of the doors, and the dimension from an end of the car in the opening direction of the doors to the suspension point is about 150 mm. Accordingly, the distance from the gravitational center of the car to the suspension point in the opening direction of the doors is $Ex=1,400/2+150=850$ mm. Also, the interval H between the upper and lower guide shoes is normally about 3,000 mm.

If such conditions are substituted in the above-described equation, the relationship of the guide shoe reactive force, $F=900\times850/3,000=255$ kg, is established. When the guide shoe reactive force becomes large, the cost is increased since it is necessary to enlarge the size of members such as the guide shoes, the guide rails and the car frame which are subjected to the guide shoe reactive force, resulting in a less economical elevator.

Also, in the above-described hydraulic elevator, since the fastening force of the plungers 5*c* and 6*c* on the packing (not shown) for preventing oil leakage from the sliding portions between the cylinders 5*b* and 6*b* and the plungers 5*c* and 6*c*, respectively, varies, the travel resistance of the plungers 5*c* and 6*c* also fluctuates. Accordingly, even if the hydraulic jacks 5 and 6 are controlled in the same manner, the extension speeds of the plungers 5*c* and 6*c* become different from each other, resulting in abnormal wear of the packing due to the slant of the plungers 5*c* and 6*c* and the application of an overly large force to the support frame 7. These factors cause the hydraulic elevator to breakdown.

Also, Japanese Patent Application Laid-Open No. 62-264186 and Japanese Patent Application Laid-Open No. 8-268664 show a hydraulic elevator in which a car is raised and lowered by using a plurality of hydraulic jacks. However, since there is a single suspension point for the suspension rope, a large reactive force is applied to the guide members for guiding the movement of the car in the vertical direction.

DISCLOSURE OF THE INVENTION

The present invention has been made in order to solve the above-noted problems, and therefore an object of the present invention is to provide a hydraulic elevator in which the reactive force applied to guide members can be reduced, and the car can be raised and lowered stably.

According to the present invention, there is provided a hydraulic elevator comprising: a pair of guide rails spaced from each other within a hoistway; a car which is interposed between the pair of guide rails and which is raised and lowered along the pair of guide rails; a plurality of hydraulic jack units spaced from each other within the hoistway so as to straddle at least a section of a vertically projected area of the car; a plurality of rotatable suspension sheaves each moved up and down by the hydraulic jack units; a stationary member located below the suspension sheaves within the hoistway; a flexible suspension means wound around the suspension sheaves with a hoistway side fastening end fastened to the stationary member and a suspension portion for suspending the car; and a hydraulic power unit for driving the hydraulic jack units and moving the suspension sheaves up and down, thereby raising and lowering the car along the pair of guide rails.

BEST MODE FOR CARRYING OUT THE INVENTION

A preferred embodiment of the present invention will now be described with reference to the accompanying drawings.

First Embodiment

Figure 1:
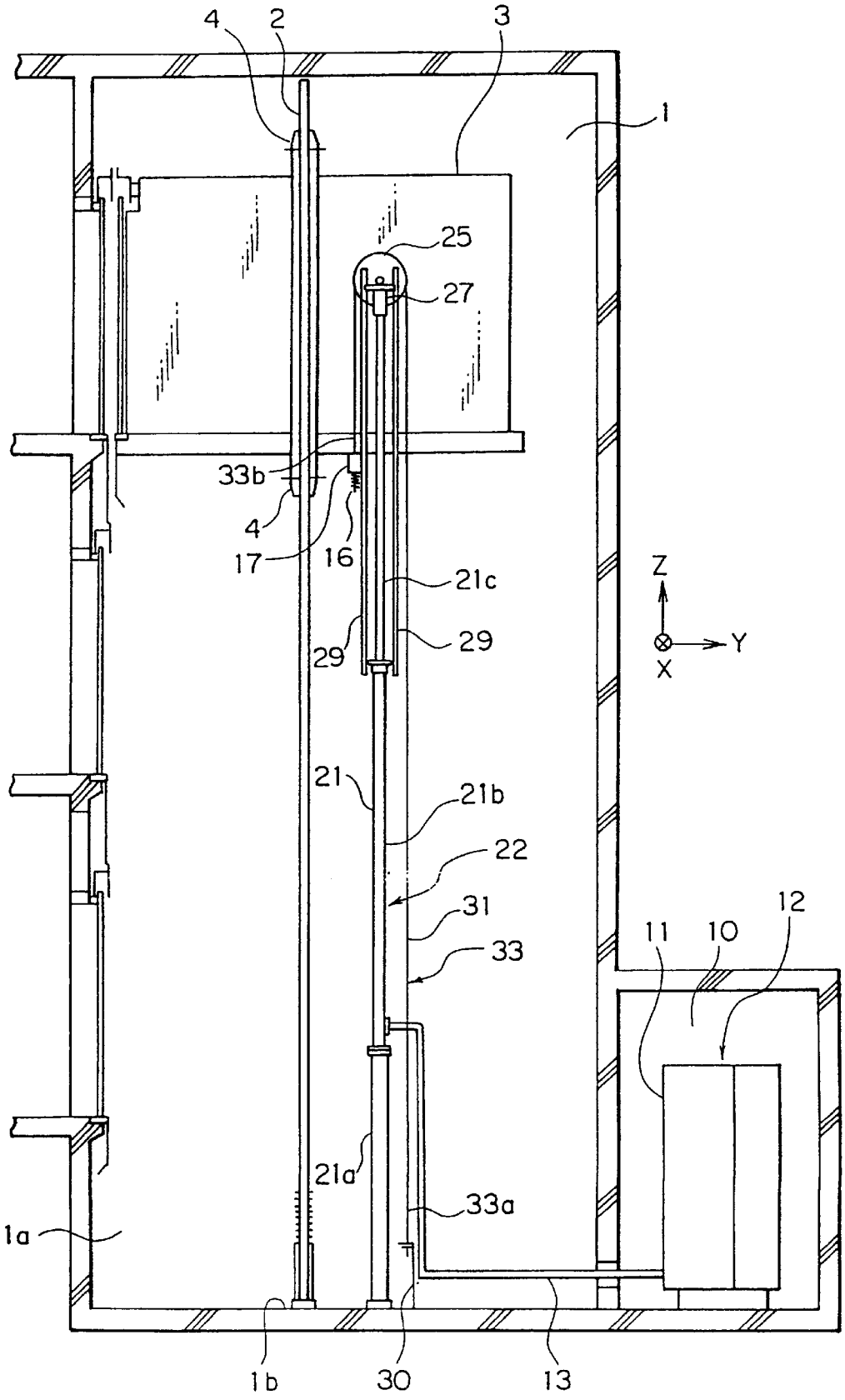
FIG. 1 is a side elevational view showing a hydraulic elevator in accordance with a first embodiment of the present invention.
Figure 2:
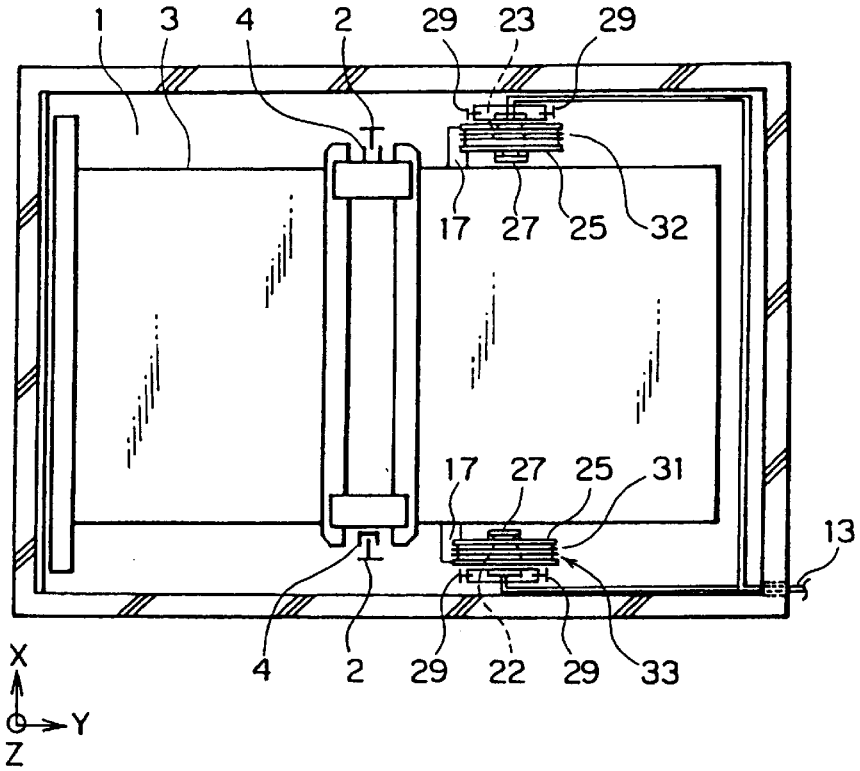
FIG. 2 is a plan view showing the hydraulic elevator shown in FIG. 1.

FIG. 1 is a side elevational view showing a hydraulic elevator in accordance with a first embodiment of the present invention. FIG. 2 is a plan view showing the hydraulic elevator shown in FIG. 1. In these drawings, a pair of guide rails 2 are disposed spaced from each other within a hoistway 1. A car 3 that is raised and lowered along the guide rails 2 is disposed between the guide rails 2. A plurality of guide shoes 4 are fixed to the car 3 as guide members that engage with the guide rails 2, respectively.

A hydraulic jack apparatus for raising and lowering the car 3 is composed of first and second hydraulic jack units 22 and 23 which are provided in the hoistway 1 at an interval from each other. The first and second hydraulic jack units 22 and 23 are composed of hydraulic jacks 21 disposed parallel to the guide rails 2 within the hoistway 1. These hydraulic jacks 21 are disposed on both sides of the car 3 so as to face each other while straddling a vertically projected area of the car 3. Each of the hydraulic jacks 21 has a jack base 21*a* fixed to the floor 1*b* of the pit 1*a* of the hoistway 1, a cylinder 21*b* fixed to the jack base 21*a*, and a plunger 21*c* inserted into the cylinder 21*b* that is reciprocated vertically.

Rotatable suspension sheaves 25 are supported through support members 27 at upper end portions of the respective plungers 21*c*. Each of the suspension sheaves 25 is disposed so that the center thereof coincides with the axis of the plunger 21*c*. The guide rails 29 for guiding the ascending/descending movement of the support members 27 are fixed to the upper end portions of the cylinders 21*b*.

A hydraulic power unit 12 having an oil tank 11 is disposed in a machine room 10 adjacent to the hoistway 1. The hydraulic power unit 12 is connected to first and second hydraulic jack units 22 and 23 through a pipe 13 branched at a midway portion thereof.

A plurality of stationary members 30 are fixed to the floor 1*b* of the pit 1*a*. The stationary members 30 are arranged below the two suspension sheaves 25, respectively. The car 3 is suspended within the hoistway 1 by a first suspension rope 31 wound around the suspension sheave 25 on the first hydraulic jack unit 22 side and by a second suspension rope 32 wound around the suspension sheave 25 on the second hydraulic jack unit 23 side. A flexible suspension means 33 is composed of the first and second suspension ropes 31 and 32.

Each of the suspension ropes 31 and 32 has a hoistway side fastening end 33*a* fastened to the stationary member 30 and a car side fastening end fastened to the car 3 as a suspension portion. The car side fastening end 33*b* is fastened to a rope support beam 17 of the car 3 through a spring 16.

Also, the first and second suspension ropes 31 and 32 extend downwardly in the vertical direction on the car 3 side of the suspension sheave 25 and on the stationary member 30 side, respectively. Thus, a force acting to slant or cock the hydraulic jack 22 and 23 is kept from being applied to the suspension sheaves 25 from the suspension ropes 31 and 32.

The operation will now be described. Pressurized oil is fed simultaneously from the hydraulic power unit 12 to the cylinders 21*b* of the first and second hydraulic jack units 22 and 23, so that the plungers 21*c* and the car 3 are raised along the guide rails 2. Also, the hydraulic oil within the cylinders 21*b* of the first and second hydraulic jack units 22 and 23 is returned to the hydraulic power unit 12 by the tare weight (dead weight) of the car 3 so that the car 3 is lowered.

In such a hydraulic elevator, since the car 3 is suspended by the suspension ropes 31 and 32 at the suspension points on both sides of the car in the opening direction of the doors, no force for rotating the car 3 around the opening of the doors (about the Y-axis in FIG. 2) is applied, and the reactive force of the guide shoes due to suspension of the car can be almost completely eliminated. Accordingly, even if dimension of the car 3 in the opening direction of the doors is enlarged, it is possible to stably raise and lower the car 3.

Also, in cases where the guide rollers (rubber rollers) are used as the guide members, it is possible with the present invention to prevent deformation of such guide rollers caused by stoppage of the car 3 in one place for a long period of time.

Further, although in the first embodiment, the hydraulic jack units 22 and 23 are arranged on both sides of the vertically projected area of the car 3, it is possible, for example, to arrange the hydraulic jack units on either the right or left side of the car 3 in the opening direction and on the rear side in the depth direction of the car 3, respectively. The guide shoe reactive force can also be absorbed to some extent in this case as well.

Second Embodiment

Figure 3:
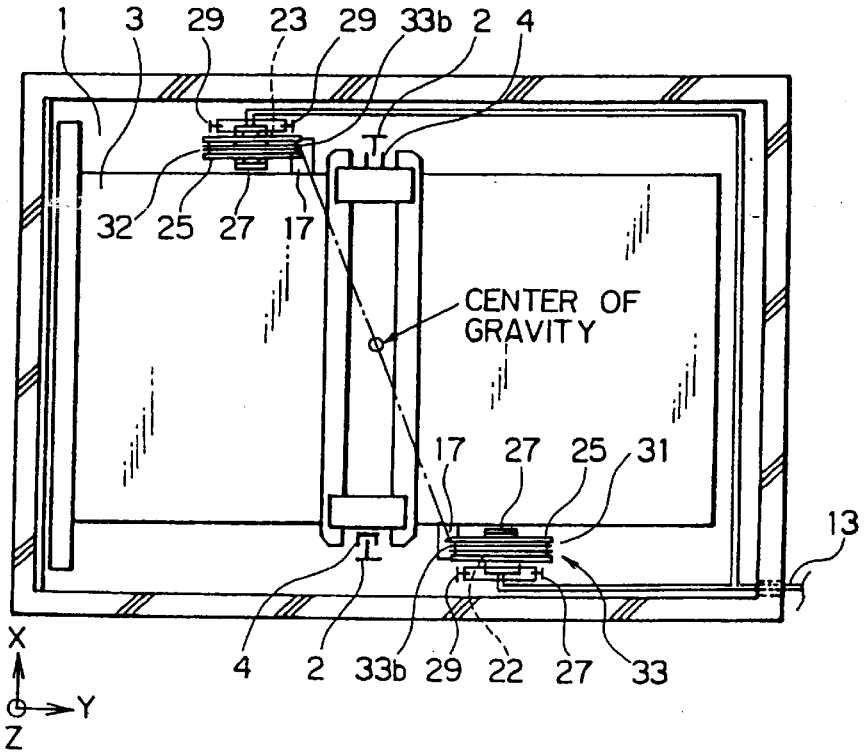
FIG. 3 is a plan view showing a hydraulic elevator in accordance with a second embodiment of the present invention.

Next, FIG. 3 is a plan view showing a hydraulic elevator in accordance with a second embodiment of the present invention. In this example, the hydraulic jack units 22 and 23 and the suspension sheaves 25 are arranged so that a straight line (dashed line) connecting the car side fastening end 33*b* of the first suspension rope 31 to the car side fastening end 33*b* of the second suspension rope 32 passes through the center of gravity of the vertically projected area of the car 3. The other structures are the same as those in the first embodiment.

In such a hydraulic elevator, neither the force for rotating the car 3 in the opening direction of the doors (about the Y-axis in the drawings) nor force for rotating the car 3 around the depth direction (about the X-axis in the drawings) is applied. Therefore, it is possible to raise and lower the car 3 in a more stable manner.

Incidentally, in the second embodiment, the first and second hydraulic jack units 22 and 23 are used. However, it is possible to use three or more hydraulic jack units. In this case, the suspension sheaves and the hydraulic jack units are arranged so that the point of application of a resultant force applied to the car by the flexible suspension means is substantially overlapped by the center of gravity of the vertically projected area of the car, so that the guide shoe reactive force may be reduced and the car can be raised and lowered stably.

Third Embodiment

Figure 4:
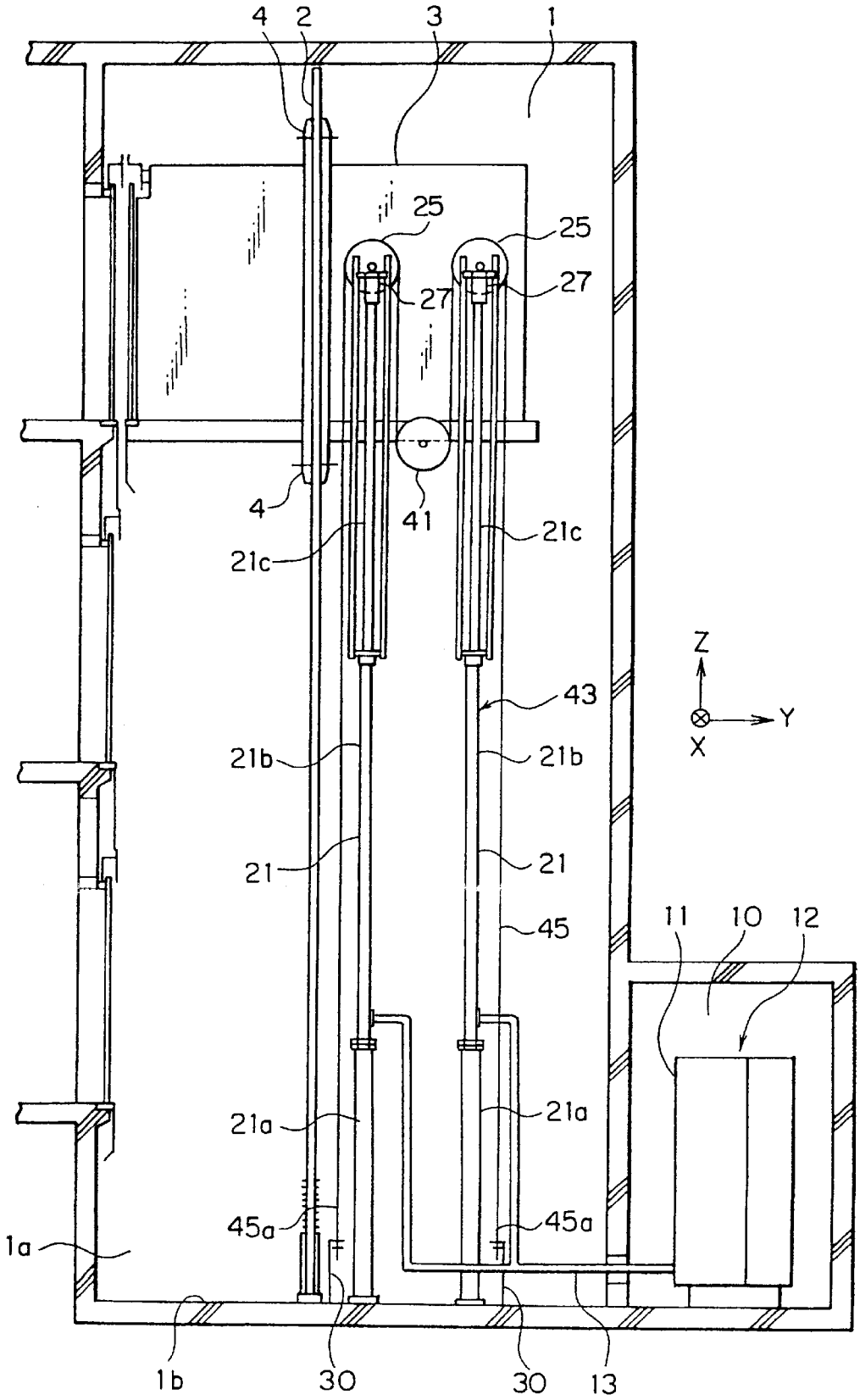
FIG. 4 is a side elevational view showing a hydraulic elevator in accordance with a third embodiment of the present invention.
Figure 5:
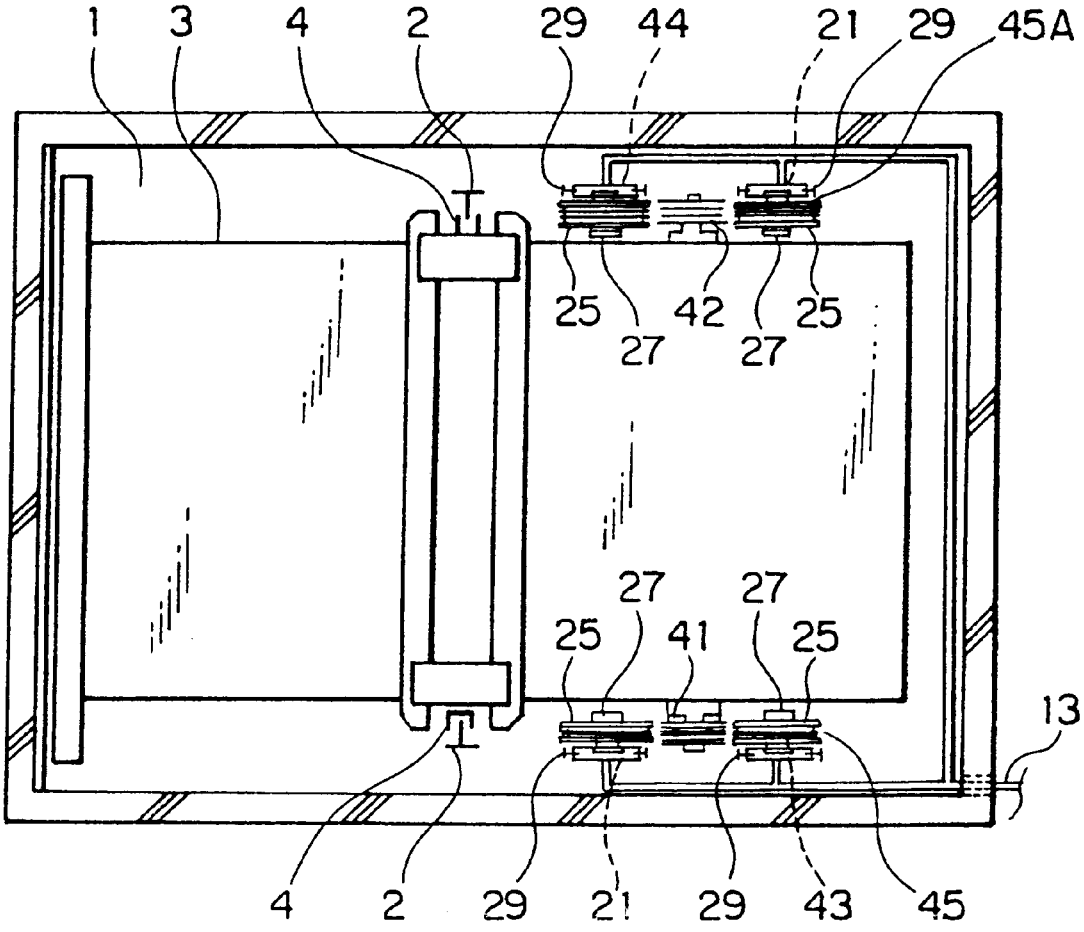
FIG. 5 is a plan view showing the hydraulic elevator shown in FIG. 4.
Figure 5:
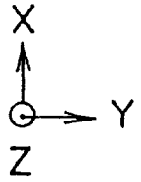

FIG. 4 is a side elevational view showing a hydraulic elevator in accordance with a third embodiment of the present invention. FIG. 5 is a plan view showing the hydraulic elevator shown in FIG. 4. In these drawings, first and second rotatable deflector sheaves 41 and 42 are provided on both sides of a lower portion of the car 3, respectively. First and second hydraulic jack units 43 and 44 are disposed within the hoistway 1 at an interval from each other so as to straddle the vertically projected area of the car 3 from both sides.

Each of the first and second hydraulic jack units 43 and 44 is composed of two hydraulic jacks 21. In the same manner as in the first embodiment, the suspension sheaves 25, the support members 27 and the guide rails 29 are provided above the respective hydraulic jacks 21.

Each flexible suspension means is composed of first and second suspension ropes 45 and 45A each having hoistway side fastening ends 45*a* at both ends. The first suspension rope 45 is wound alternately around the two suspension sheaves 25 which are moved up and down by the first hydraulic jack unit 43, and the first deflector sheave 41. The second suspension rope 45A is wound alternately around the two suspension sheaves 25 which are moved up and down by the second hydraulic jack unit 44, and the second deflector sheave 42. The other structures are the same as those in the first embodiment.

In such a hydraulic elevator, since the car 3 is suspended by the suspension ropes 45 and 45A at the suspension points on both sides of the car in the opening direction of the doors, no force for rotating the car 3 around the opening of the doors (about the Y-axis in the drawings) is generated, and it is possible to substantially eliminate the guide shoe reactive force due to suspension of the car 3. Accordingly, even if the dimension of in the car 3 the opening direction of the doors is enlarged, it is possible to raise and lower the car 3 stably.

Also, since the first suspension rope 45 is wound alternately around the two suspension sheaves 25 and the first deflector sheave 41, and the second suspension rope 45A is wound alternately around the two suspension sheaves 25 and the second deflector sheave 42, the expansion/retraction difference of the two hydraulic jacks 21 of the first hydraulic jack unit 43 is absorbed by the rotation of the first deflector sheave 41 and the expansion/retraction difference of the two hydraulic jacks 21 of the second hydraulic jack unit 44 is absorbed by the rotation of the second deflector sheave 42, to thereby avoid a breakdown of the hydraulic elevator caused by localized wear of the packing or the like.

Further, in the third embodiment, the first and second hydraulic jack units 43 and 44 are arranged on the rear side of the car 3 relative to the guide rails 2. However, one of the hydraulic jack units may be arranged closer to the front side of the car 3 than the guide rails 2 so that a straight line connecting the centers of the two deflector sheaves passes through the center of gravity of the vertically projected area of the car 3. With such an arrangement, the forces for rotating the car 3 around the depth direction (about the X-axis in the drawings) are canceled so that the car 3 can be raised and lowered in a more stable manner.

Fourth Embodiment

Figure 6:
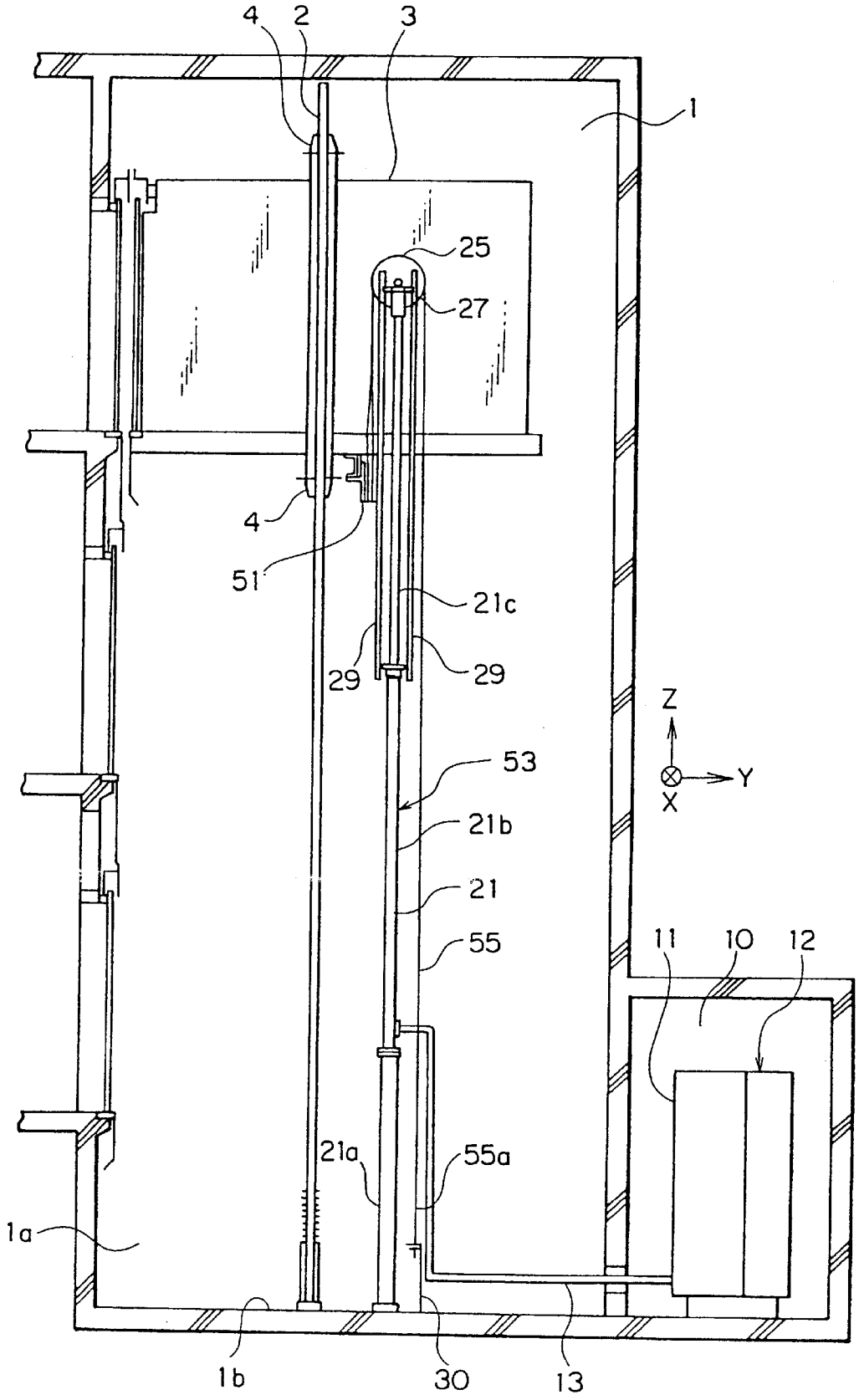
FIG. 6 is a side elevational view showing a hydraulic elevator in accordance with a fourth embodiment of the present invention.
Figure 7:
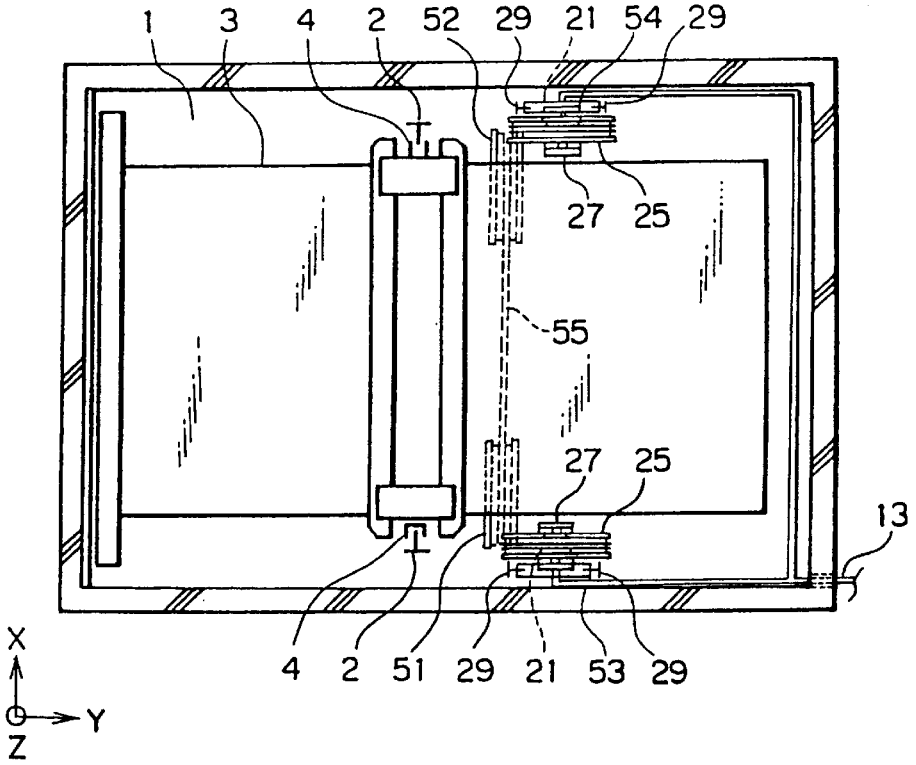
FIG. 7 is a plan view showing the hydraulic elevator shown in FIG. 6.

FIG. 6 is a side elevational view showing a hydraulic elevator in accordance with a fourth embodiment of the present invention. FIG. 7 is a plan view showing the hydraulic elevator shown in FIG. 6. In these drawings, a pair of deflector sheaves 51 and 52 are arranged spaced from each other on both sides under the car 3. These deflector sheaves 51 and 52 may be rotated about an axis extending in the depth direction of the car 3, respectively.

The first and second hydraulic jack units 53 and 54 are disposed at an interval from each other in the hoistway 1 so as to straddle the vertically projected area of the car 3 from both sides. The first and second hydraulic jack units 53 and 54 each have a hydraulic jack 21.

A flexible suspension means is composed of a single continuous suspension rope 55 having hoistway side fastening ends 55*a* fastened to the stationary members 30 at both ends thereof. An intermediate portion of the suspension rope 55 is wound successively around the suspension sheave 25 on the first hydraulic jack unit 53 side, the first deflector sheave 51, the second deflector sheave 52, and the suspension sheave 25 on the second hydraulic jack unit 54 side, in that order.

In such a hydraulic elevator, since the car 3 is suspended at the suspension points on both sides in the opening direction, i.e., at the deflector sheaves 51 and 52 by the rope 55, no force for rotating the car 3 around the opening direction of the doors (about the Y-axis in the drawings) is applied, and it is possible to substantially eliminate the guide shoe reactive force due to suspension of the car 3. Accordingly, even if the opening dimension of the car 3 in the opening direction of the doors is enlarged, it is possible to raise and lower the car 3 stably.

Also, the expansion/retraction difference of the two hydraulic jacks 21 may be absorbed by the first and second deflector sheaves 51 and 52, to thereby avoid a breakdown of the hydraulic elevator caused by localized wear of the packing or the like.

Furthermore, since the flexible suspension means is composed of the single suspension rope 55, the structure is simplified.

Fifth Embodiment

Figure 8:
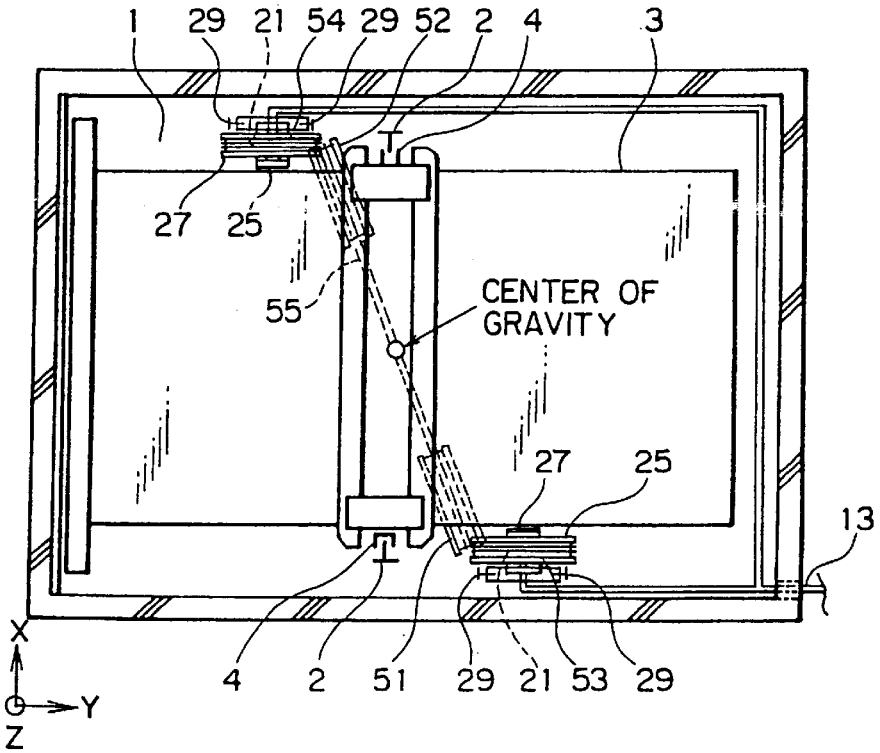
FIG. 8 is a plan view showing a hydraulic elevator in accordance with a fifth embodiment of the present invention.
Figure 9:
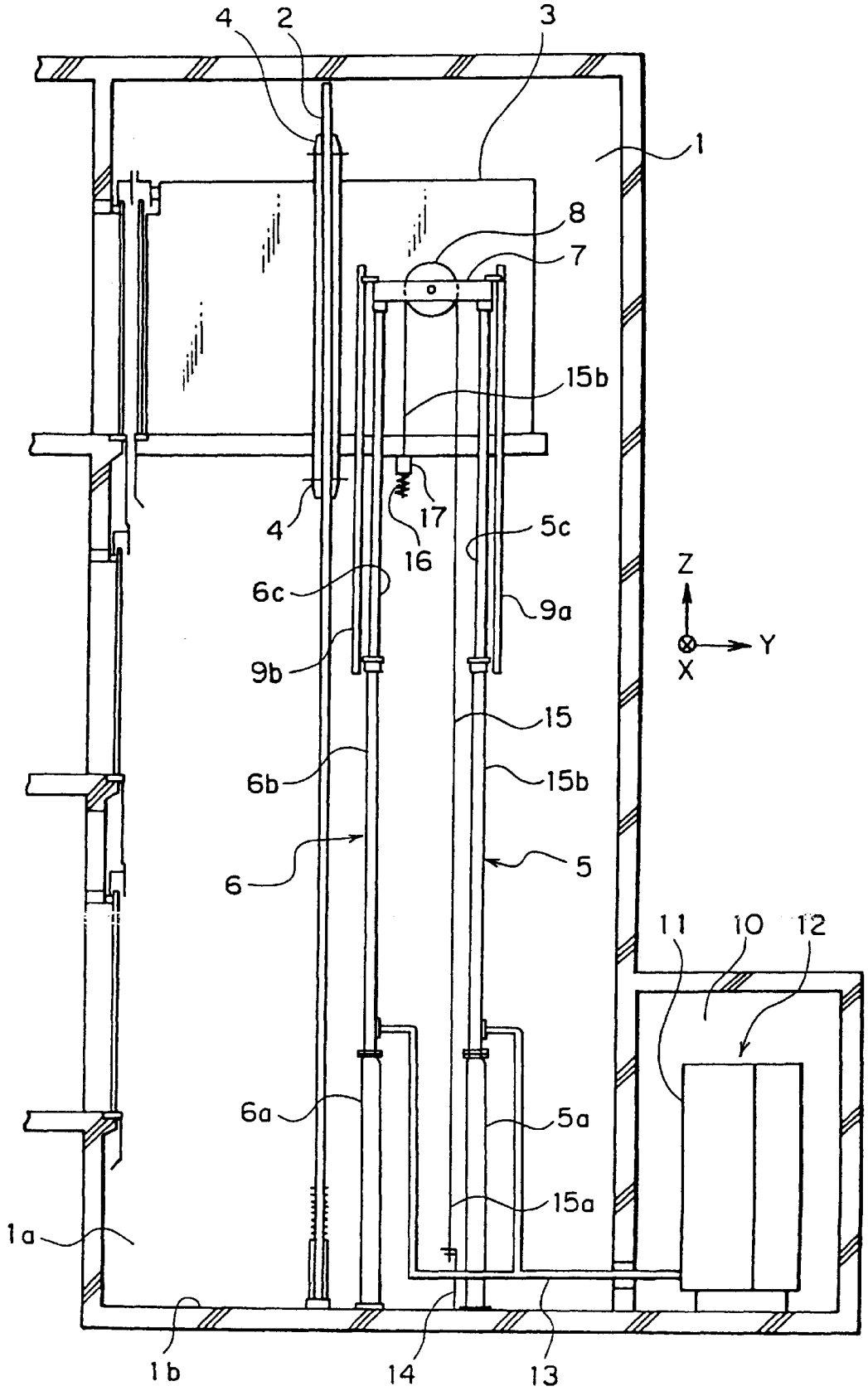
FIG. 9 (PRIOR ART)
FIG. 9 is a side elevational view showing a conventional hydraulic elevator.
Figure 10:
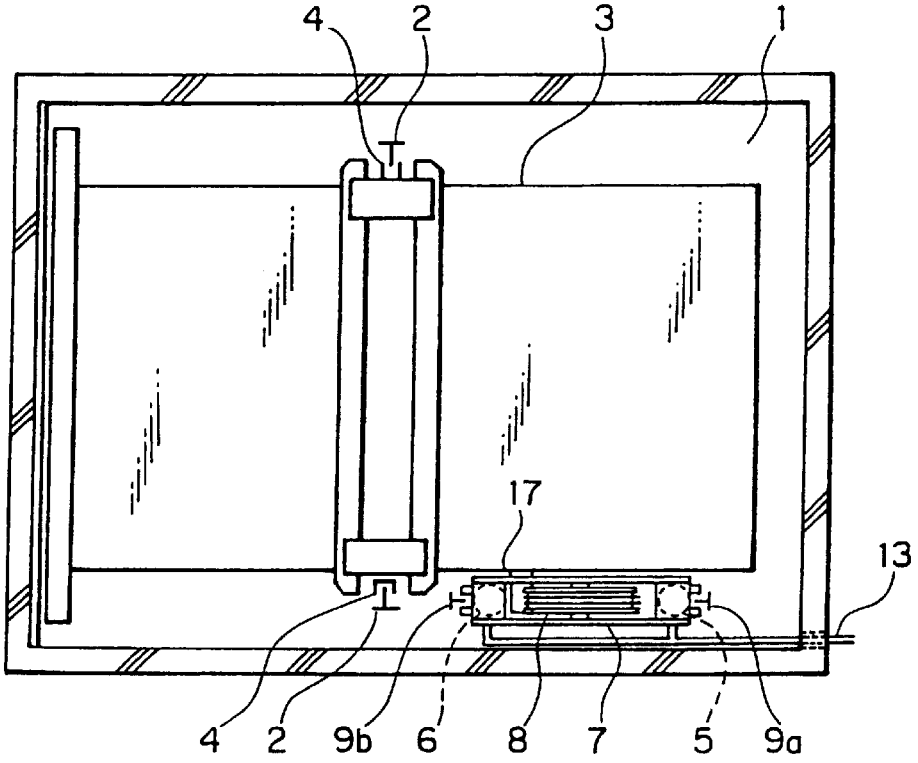
FIG. 10 PRIOR ART
FIG. 10 is a plan view showing the hydraulic elevator shown in FIG. 9.
Figure 11:
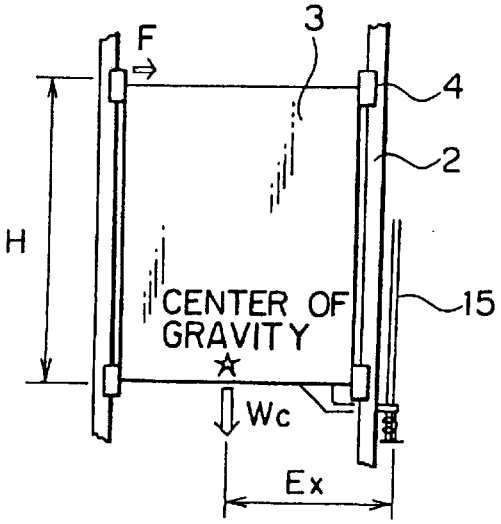
FIG. 11 PRIOR ART
FIG. 11 is an illustration of a guide shoe reactive force applied to guide shoes shown in FIG. 9.

FIG. 8 is a plan view showing a hydraulic elevator in accordance with a fifth embodiment of the present invention. In this example, the deflector sheaves 51 and 52, the hydraulic jack units 53 and 54 and the suspension sheaves 25 are arranged so that the suspension rope 55 passes through the center of gravity of the vertically projected area of the car 3. The other structures are the same as those in the fourth embodiment.

In such a hydraulic elevator, neither the force for rotating the car 3 around the opening direction of the doors (about the Y-axis in the drawings) nor the force for rotating the car 3 around the depth direction (about the X-axis in the drawings) is applied. Therefore, it is possible to raise and lower the car 3 in a more stable manner.

What is claimed is:

1. A hydraulic elevator comprising:

a pair of guide rails spaced from each other within a hoistway;

a car interposed between said pair of guide rails and raised and lowered along said pair of guide rails;

first and second hydraulic jack units juxtaposed with said guide rails on opposite sides of said car, each of said first and second hydraulic jack units including two hydraulic jacks;

first and second pairs of rotatable suspension sheaves respectively moved up and down by said first and second hydraulic jack units;

first and second rotatable deflector sheaves located on opposite sides of said car;

stationary members located below said suspension sheaves within the hoistway;

a first suspension rope wound alternately around the first pair of suspension sheaves moved up and down by said first hydraulic jack unit and said first deflector sheave, ends of said first suspension rope being fastened to said stationary members;

a second suspension rope wound alternately around the second pair of suspension sheaves moved up and down by said second hydraulic jack unit and said second deflector sheave, ends of said second suspension rope being fastened to said stationary members; and a hydraulic power unit for driving said first and second hydraulic jack units and moving said first and second pairs of suspension sheaves up and down, thereby raising and lowering said car along said pair of guide rails.

2. The hydraulic elevator according to claim 1, wherein said first and second hydraulic jack units and said first and second deflected sheaves are disposed so that a straight line connecting the centers of said first and second deflector sheaves passes through the center of gravity of said car when said car and said first and second deflector sheaves are projected vertically onto a horizontal plane.

3. The hydraulic elevator according to claim 1, wherein each of said suspension sheaves is supported at an upper end of a respective one of said hydraulic jacks, and said first and second suspension ropes extend downwardly in a vertical direction on both side of said suspension sheaves.

* * * * *

UNITED STATES PATENT AND TRADEMARK OFFICE

CERTIFICATE OF CORRECTION

PATENT NO. : 6,290,026 B1
DATED : September 18, 2001
INVENTOR(S) : Yukihiro Takigawa It is certified that error appears in the above-identified patent and that said Letters Patent is hereby corrected as shown below:

Title page,
Item [22], should read -- (22) July 6, 1998 --

Signed and Sealed this

Eleventh Day of June, 2002

*Attest:*

*Attesting Officer*

JAMES E. ROGAN
*Director of the United States Patent and Trademark Office*